US011063380B2

(12) United States Patent
Wu et al.

(10) Patent No.: US 11,063,380 B2
(45) Date of Patent: Jul. 13, 2021

(54) UNIVERSAL POWER INPUT ASSEMBLY

(71) Applicant: Delta Electronics (Shanghai) CO., LTD, Shanghai (CN)

(72) Inventors: Xiaojun Wu, Shanghai (CN); Baohua Li, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 0 days.

(21) Appl. No.: 16/805,078

(22) Filed: Feb. 28, 2020

(65) Prior Publication Data

US 2020/0287304 A1 Sep. 10, 2020

(30) Foreign Application Priority Data

Mar. 4, 2019 (CN) ..... 201920269979.0

(51) Int. Cl.

| | |
|---|---|
| ***H01R 12/57*** | (2011.01) |
| ***H01R 12/52*** | (2011.01) |
| ***H01R 4/30*** | (2006.01) |
| ***H01R 4/02*** | (2006.01) |
| ***H01R 12/73*** | (2011.01) |

(52) U.S. Cl.

CPC ..... *H01R 12/57* (2013.01); *H01R 4/027* (2013.01); *H01R 4/30* (2013.01); *H01R 12/52* (2013.01); *H01R 12/737* (2013.01)

(58) Field of Classification Search

None

See application file for complete search history.

(56) References Cited

U.S. PATENT DOCUMENTS

| | | | | |
|---|---|---|---|---|
| 4,693,529 | A * | 9/1987 | Stillie | H01R 12/52 439/493 |
| 5,241,451 | A * | 8/1993 | Walburn | H05K 7/142 24/453 |
| 9,147,952 | B2 * | 9/2015 | Kikuchi | H01R 13/625 |
| 2007/0197091 | A1 * | 8/2007 | Hsieh | H01R 12/52 439/607.01 |
| 2008/0298035 | A1 * | 12/2008 | Kajio | H05K 1/0263 361/784 |
| 2010/0253155 | A1 * | 10/2010 | Lu | H05K 7/1432 307/147 |

FOREIGN PATENT DOCUMENTS

| | | |
|---|---|---|
| CN | 201766484 U | 3/2011 |
| CN | 106716741 A | 5/2017 |

* cited by examiner

*Primary Examiner* — Oscar C Jimenez

(74) *Attorney, Agent, or Firm* — Qinghong Xu

(57) ABSTRACT

A universal power input assembly includes an input power terminal, a first circuit board and a second circuit board. The input power terminal is electrically coupled to the first circuit board and the first circuit board includes a connector, wherein a first end of the connector is electrically coupled to the first circuit board and a second end of the connector is electrically coupled to the second circuit board.

10 Claims, 12 Drawing Sheets

UNIVERSAL POWER INPUT ASSEMBLY

CROSS-REFERENCE TO RELATED APPLICATIONS

This application is based upon and claims priority to Chinese Patent Application 201920269979.0, filed on Mar. 4, 2019, the entire contents of which are incorporated herein by reference.

TECHNICAL FIELD

The present disclosure generally relates to power technology, and more particularly, to a universal power input assembly.

BACKGROUND

A configurable power supply is implemented with various types of AC power sockets for different users. Meanwhile, the printed circuit board (PCB) used for power supply is universal. Different types of AC power sockets adopt the same PCB as the motherboard to avoid redesigning the layout of internal components of the power supply and changing the overall electrical characteristics of the power supply.

An existing design for configurable power supply is that a wire is used to connect the AC power socket to the motherboard, so that the AC power socket can be replaced without changing the motherboard. However, since the maximum AC input current can increase to 1.5 A, a 14 AWG (American Wire Gauge, a standard of the diameter of the wire) wire is required to connect the input power terminal and the motherboard. One end of the wire is soldered on the pin of the AC power socket, and the other end is connected to the corresponding pin of the motherboard by a pluggable press. However, this solution has the following disadvantages.

Restricted by the manufacturing process of the wire, the shortest length of 14AWG wire is 50 mm After the wire is soldered on the pin of the AC power socket, the socket is then assembled with the motherboard. Since the space left for the power socket is relatively small for higher power density, the 14 AWG wire is relatively thick and unpliant, the wire is applied with great stress after bending, which causes difficulties in assembling and the solder joints of the power socket are overstressed, which may reduce the safety and reliability of the configurable power supply.

SUMMARY

The present disclosure provides a universal power input assembly. The power input assembly includes a first circuit board, coupled to a power input socket, and an input power is coupled to a motherboard via the first circuit board. Therefore, the power input socket is then replaceable with different first circuit boards implemented.

In one embodiment of the present disclosure, a universal power input assembly comprises an input power terminal, a first circuit board, and a second circuit board. The input power terminal is electrically coupled to the first circuit board, and the first circuit board includes a connector, wherein a first end of the connector is electrically coupled to the first circuit board and a second end of the connector is electrically coupled to the second circuit board.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise specified. The implementations set forth in the following description of exemplary embodiments do not represent all implementations consistent with the invention. Instead, they are merely examples of apparatuses and methods consistent with aspects related to the invention as recited in the appended claims.

In order to solve the technical problems in the industry, the present disclosure provides a universal power input assembly. The universal power input assembly includes an input power terminal, a first circuit board and a second circuit board. The input power terminal is electrically coupled to the first circuit board. The first circuit hoard includes a connector. The connector includes a first end electrically coupled to the first circuit board and a second end electrically coupled to the second circuit board. The second circuit board is configured as a motherboard. Therefore, an input power is coupled, by a first circuit board coupled to an input power terminal, to the motherboard of the universal power input assembly of the present disclosure. The input power terminal is then replaceable with different first circuit boards implemented, while the motherboard doesn't need to be replaced.

Figure 1:
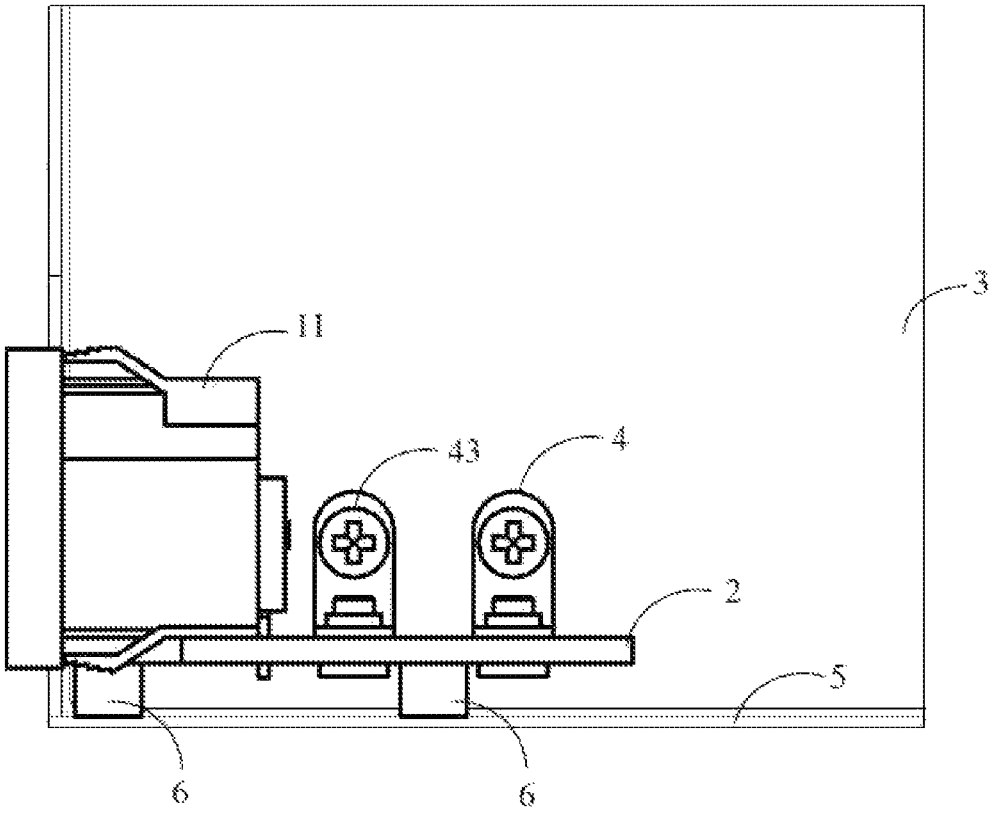
FIG. 1 shows a schematic view of a structure of a power input assembly of a first embodiment of the present disclosure.
Figure 2:
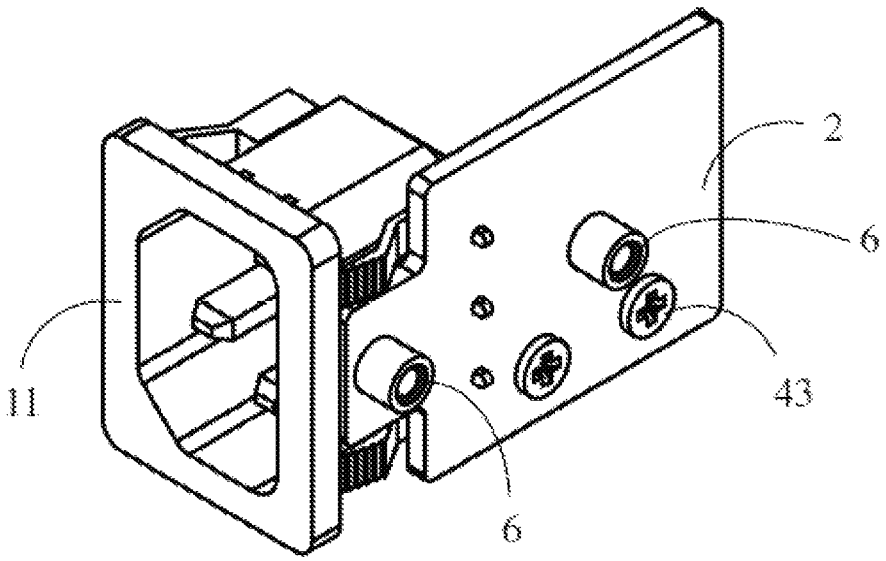
FIGS. 2 and 3 show schematic views of a first circuit board connected to an input power terminal of the first embodiment of the present disclosure.
Figure 3:
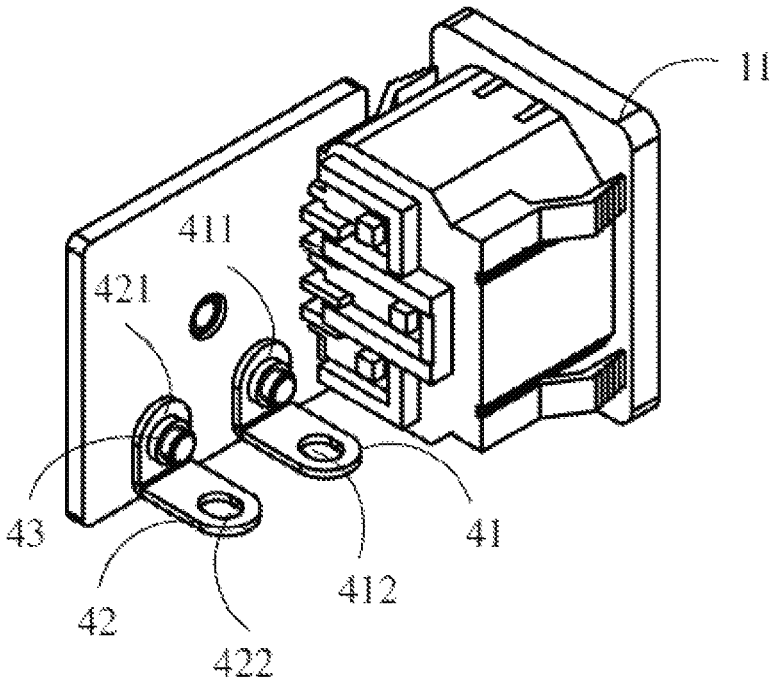
Figure 4:
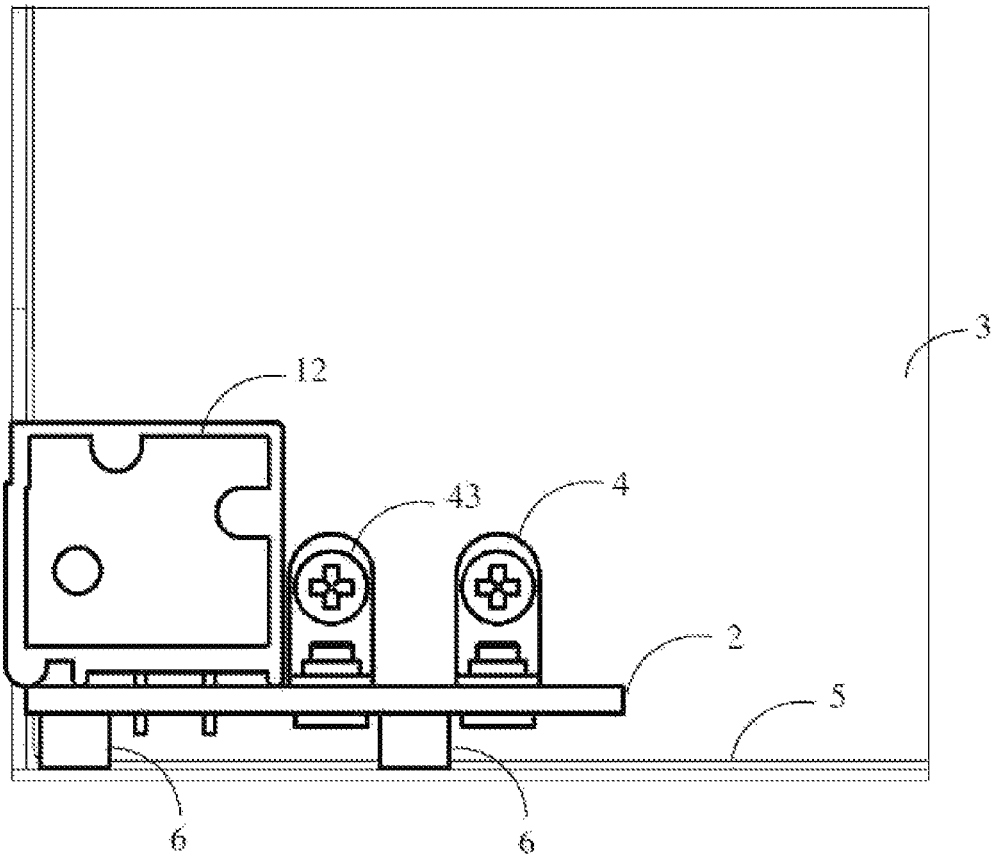
FIG. 4 shows a schematic view of a structure of a power input assembly of a second embodiment of the present disclosure.
Figure 5:
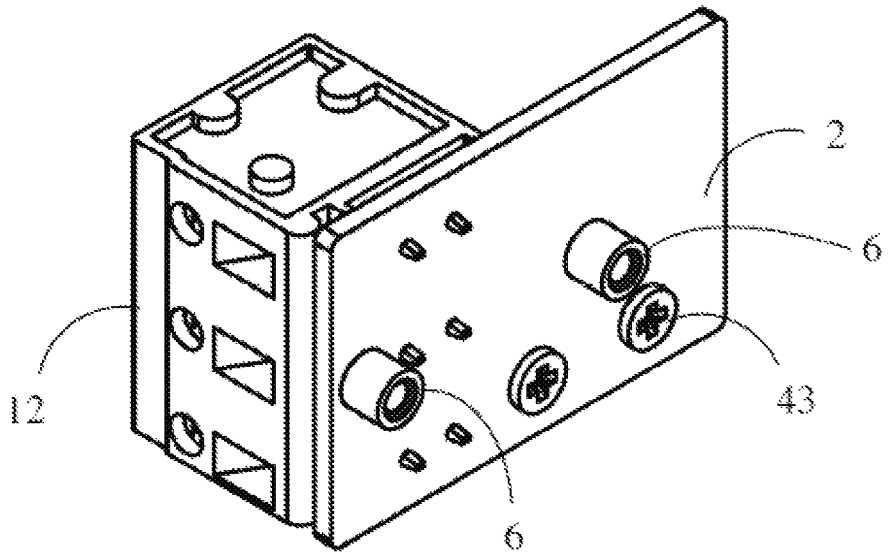
FIGS. 5 and 6 show schematic views of a first circuit board connected to an input power terminal of the second embodiment of the present disclosure.
Figure 6:
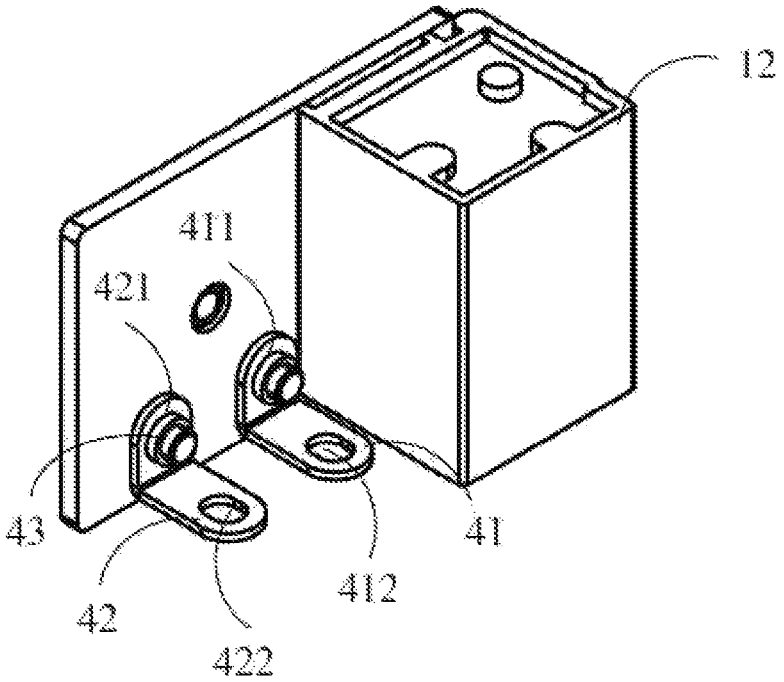
Figure 7:
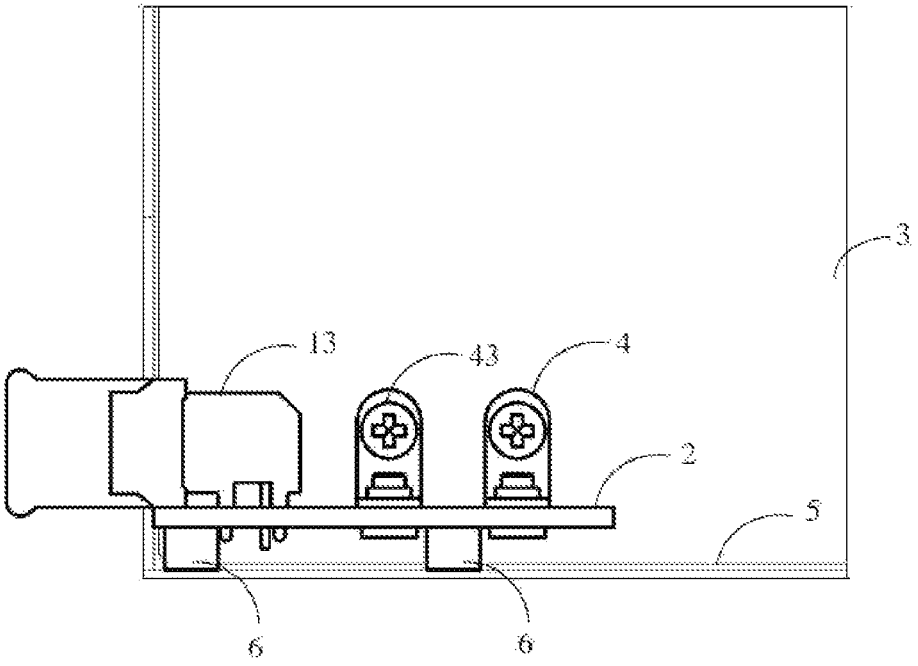
FIG. 7 shows a schematic view of a structure of a power input assembly of a third embodiment of the present disclosure.
Figure 8:
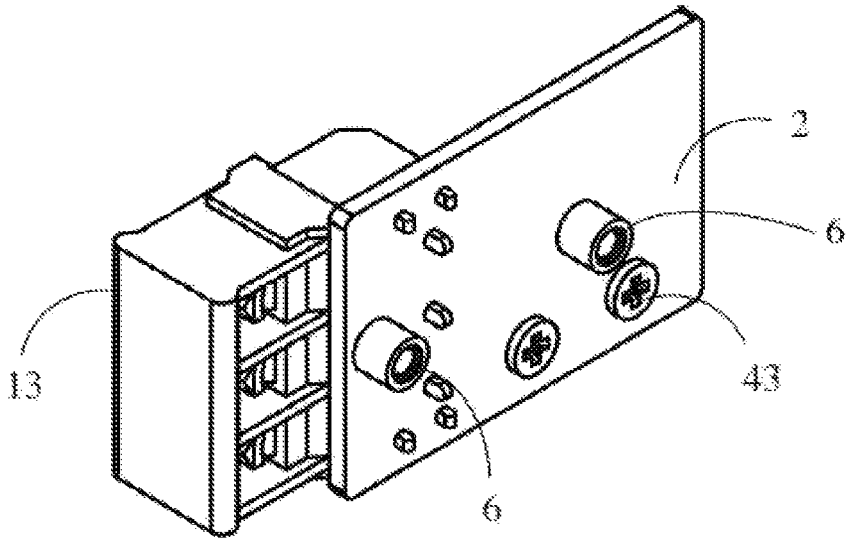
FIGS. 8 and 9 show schematic views of a first circuit board connected to an input power terminal of the third embodiment of the present disclosure.
Figure 9:
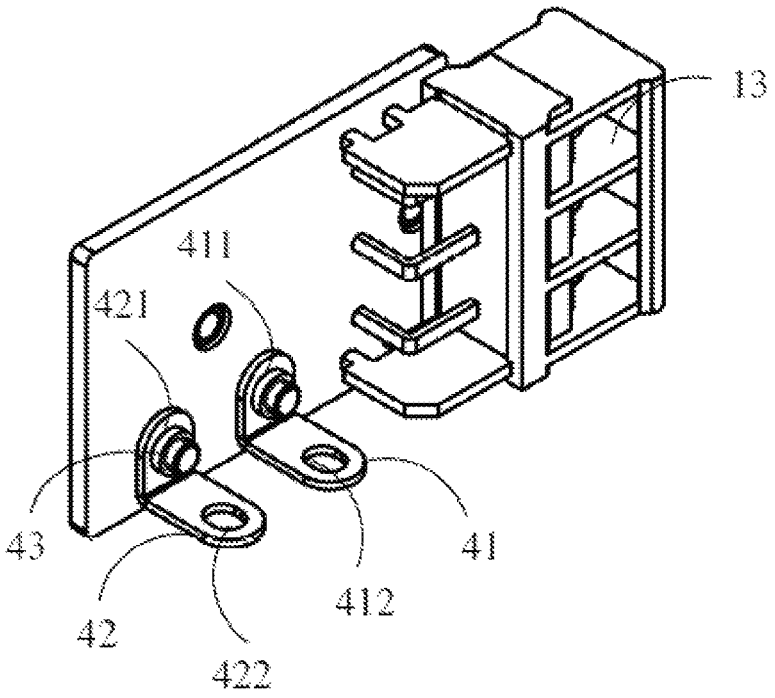

An input power terminal of the universal power input assembly can be various. The following are three embodiments of the input power terminals of the universal power input assembly disclosed by the present disclosure. FIGS. 1 to 3 show a schematic view of a universal power input assembly of a first embodiment of the present disclosure. In this embodiment, the input power terminals adopt International Electroctechnical Commission (IEC) standards for power socket. FIGS. 4 to 6 show schematic views of a structure of a power input assembly of a second embodiment of the present disclosure. The input power terminal, in this embodiment, adopts the European standard for power socket. FIGS. 7 to 9 show schematic views of a structure of a power input assembly of a third embodiment of the present disclosure. In this embodiment, the input power terminal adopts the American standard for power socket. The three types of input power terminals described here with reference to these three embodiments are examples. Other types of input power terminals are within the scope of the present disclosure.

As shown in FIGS. 1 to 3, FIGS. 1 to 3 show a schematic view of a universal power input assembly of a first embodiment of the present disclosure. In this embodiment, the universal power input assembly includes an input power terminal 11, a first circuit hoard 2 and a second circuit board 3. The input power terminal 11 is coupled to the first circuit board 2. The first circuit board 2 includes a connector 4. A first end of the connector 4 is electrically coupled to the first circuit board 2. A second end of the connector 4 is electrically coupled to the second circuit board 3.

In this embodiment, the first circuit board 2 and the second circuit board 3 are disposed perpendicular to each other. The universal power input assembly further includes a case 5 for holding the first circuit board 2 and the third circuit board 3. The first circuit board 2 is disposed close to a side wall of the case 5. The second circuit board 3 is disposed close to the bottom of the case 5. The connector 4 is an L-shaped connector, including a first connecting arm and a second connecting arm. A crossing angle between the two connecting arms is adjusted according to the crossing angle between the first circuit board 2 and the second circuit board 3. A first end of the connector 4, i.e. the first connecting arm, is electrically coupled to the first circuit board 2. A second end of the connector 4, i.e. the second connecting arm, is electrically coupled to the second circuit board 3.

In this embodiment, the first circuit board 2 occupies a smaller space of the case of the power input assembly and the power input assembly then is more compact, compared with using AWG14 wire to connect the input terminal to the motherboard. The power input assembly is easy to design and implement, and has high reliability on the basis of meeting certain electrical connection requirements.

Figure 10:
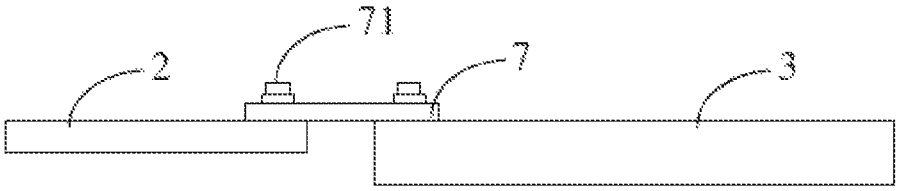
FIG. 10 shows a schematic view of a first circuit board connected to a second circuit board of the fourth embodiment of the present disclosure.

In some embodiments, the first circuit board 2 and the second circuit board 3 are not disposed perpendicular to each other. As shown in FIG. 10, a fourth embodiment, and FIG. 11, a fifth embodiment, the first circuit board 2 and the second circuit board 3 are disposed in different ways.

Figure 11:
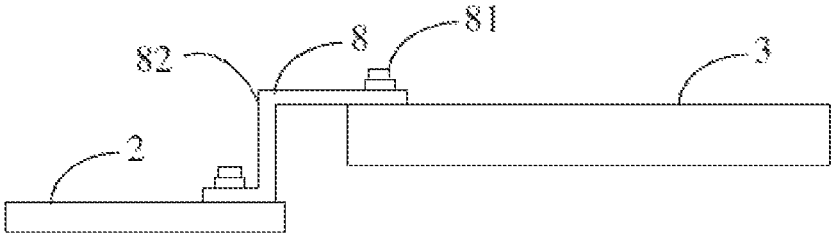
FIG. 11 shows a schematic view of a first circuit hoard connected to a second circuit board of the fifth embodiment of the present disclosure.

As shown in FIG. 10, in the fourth embodiment, the first circuit board 2 and the second circuit board 3 are disposed on the same plane. A connector 7, in this embodiment, includes a flat connector. Two ends of the connector 7 are disposed on the same plane and the two ends are respectively mounted, via fasteners 71, on the first circuit board 2 and the second circuit board 3. As shown in FIG. 11, in the fifth embodiment, the first circuit board 2 and the second circuit board 3 are disposed in parallel, on different planes. A connector 8 includes a bended portion 82. Two ends of the connector 8 are respectively mounted, via fasteners 81, on the first circuit board 2 and the second circuit board 3.

Figure 12:
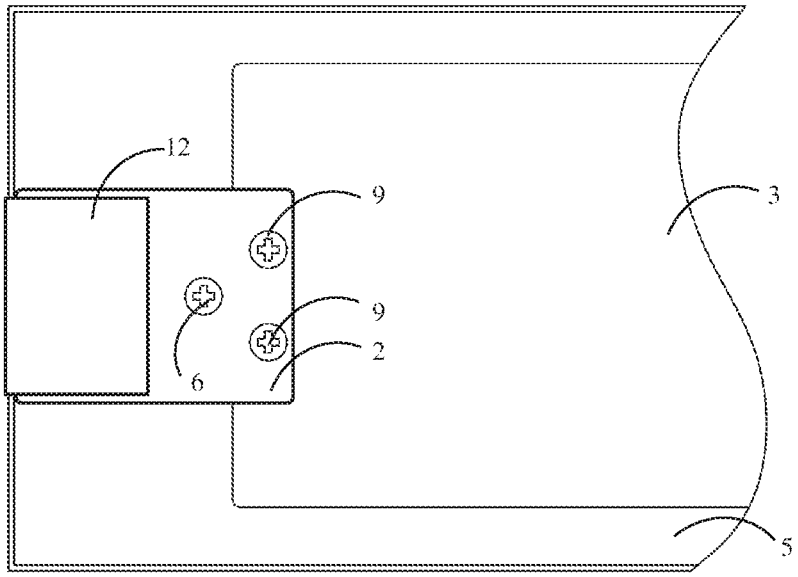
FIGS. 12 and 13 show schematic views of a first circuit board connected to a second circuit board of the sixth embodiment of the present disclosure.
Figure 13:
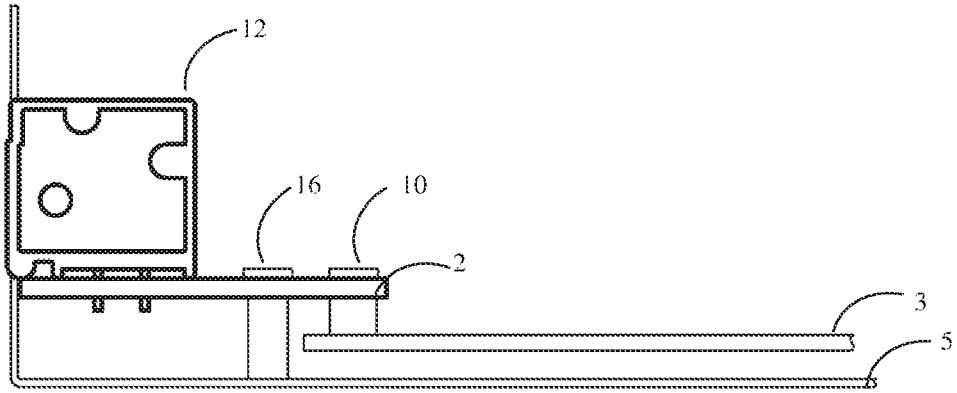
Figure 14:
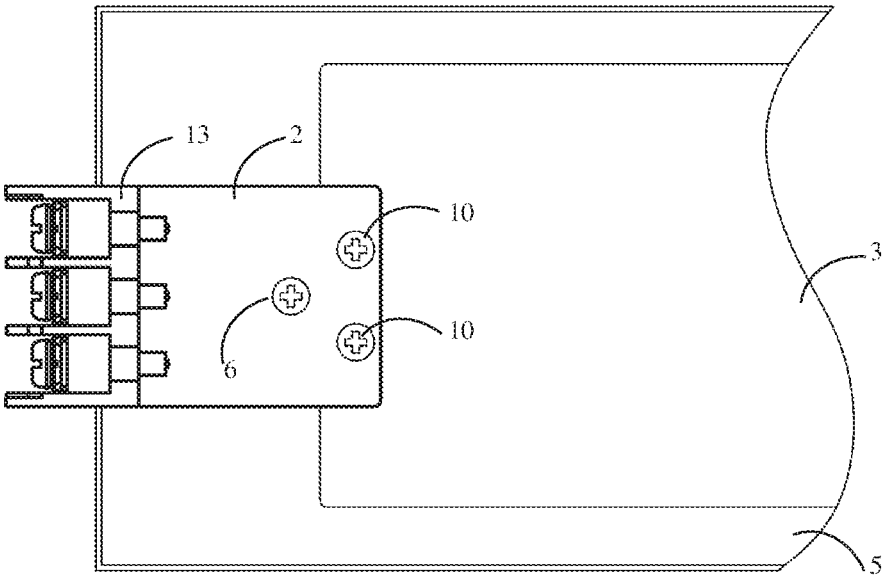
FIGS. 14 and 15 show schematic views of a first circuit board connected to a second circuit board of the seventh embodiment of the present disclosure.
Figure 15:
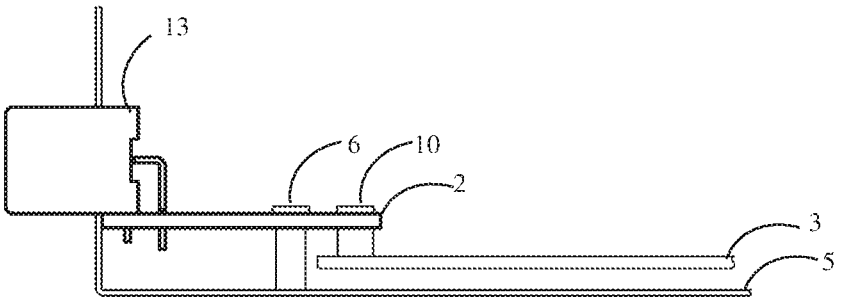

In some embodiments, the first circuit board 2 and the second circuit board 3 are connected by another kind of connector, as shown in FIG. 12-13, a sixth embodiment, and FIG. 14-15, a seventh embodiment, the first circuit board 2 and the second circuit board 3 are connected by connector 9, which can be a fastener, for example.

As shown in FIG. 12-13, in the sixth embodiment, the first circuit board 2 and the second circuit board 3 are disposed in parallel, on different planes. A connector 9, in this embodiment, includes a fastener. The first circuit board 2 and the second circuit board 3 are connected by a bolt-and-nut mechanism, for example. The nut can be directly soldered or mechanically fixed on the first circuit board 2 or the second circuit board 3. As shown in FIG. 14-15, in the seventh embodiment, the first circuit board 2 and the second circuit board 3 are disposed in parallel, on different planes. A connector 10 in this embodiment, includes a fastener. The first circuit board 2 and the second circuit board 3 are connected by a bolt-and-nut mechanism, for example. The nut can be directly soldered or mechanically fixed on the first circuit board 2 or the second circuit board 3.

It should be noticed that the second circuit board 3 and the case 5, shown in FIG. 1, are a schematic portion view of the actual power input assembly. The size of the second circuit board 3 shown in FIG. 1 is not limited herein. The size of the first circuit board 2 and the second circuit board 3 is determined in response to the requirements and the inner space of the case 5. In some embodiment, the size of the first circuit hoard 2 is smaller than the size of the second circuit board 3 but is not limited herein. In some embodiments, the first circuit board 2 is not disposed in the inner space of the case 5 but is disposed outside of the case 5, which is within the scope of the present disclosure.

In this embodiment, the input power terminal 11 includes Alternative Current (AC) power socket. The connector 4 includes a wire connector 41 and a wire connector 42, respectively connected to the positive line and negative line of input power, wherein a first end of the L-shaped wire connector 41 is electrically coupled to the first circuit board 2 and a second end of the L-shaped wire connector 41 is electrically coupled to the second circuit board 3 and a first end of the L-shaped wire connector 42 is electrically coupled to the first circuit hoard 2 and a second end of the L-shaped wire connector 42 is electrically coupled to the second circuit board 3.

In this embodiment, the first end of the connector 4 includes a first opening and the second end of the connector 4 includes a second opening. The first end of the connector 4 is mounted on the first circuit board 2 by a fastener 43 passing through the first opening and the second end of the connector 4 is mounted on the second circuit board 3 by a fastener 43 passing through the second opening. In some embodiments, two ends of the L-shaped wire connector 41 respectively includes a first opening 411 and a second opening 412. Two ends of the L-shaped wire connector 42 respectively includes a third opening 421 and a fourth opening 422. Each of the first opening 411, the second opening 412, the third opening 413 and the fourth opening 422 includes the fastener 43. The fastener 43 includes a bolt. In some embodiments, the fastener 43 includes a rivet. The detachable connection between the connector 4 and the motherboard, i.e. the second circuit board 3, is achieved by the fastener 43, With the second circuit board 3 being the same, the first circuit board 2 is replaced respectively with the required input power terminal to increase generality of the power input assembly.

In some other embodiments, the first end of the connector 4 is directly soldered on the first circuit board 2 and the second end of the connector 4 is directly soldered on the second circuit board 3. In some embodiments, the first end of the connector 4 is directly soldered on the first circuit 2 and the second end of the connector 4 is coupled to the second circuit board 3 by the fastener 43. In some embodiments, the first end of the connector 4 is coupled to the first circuit board 2 by the fastener 43 and the second end of the connector 4 is directly soldered on the second circuit board 3.

In some embodiments, the first circuit hoard 2 is mounted on the case 5 by a case fastener 6, and a ground terminal of the first circuit board 2 is electrically coupled to the case 5. The case fastener 6, in some embodiments, includes a bolt. In some embodiments, the case fastener 6 includes a rivet. The location and the quantity of the case fasteners 6 are arranged according to the size of the first circuit board 2. For the first circuit board 2 with larger size, the quantity of the case fastener 6 may be increased and is not limited herein.

The input power terminal 11 is soldered on the first circuit board 2. In some embodiment, a conducting plate is disposed at the connecting portion of the input power terminal and the first circuit board 2. A pin of the input power terminal 11 is soldered on the conducting plate for achieving electrical connection between the input power terminal 11 and the first circuit board 2. In other embodiments, the input power terminal 11 is mounted on the first circuit board 2 by a metal connector and the electrical connection between the input power terminal 11 and the first circuit board 2 is then achieved.

The first circuit board 2, in some embodiments, includes a single layer board. In some embodiments, the first circuit board 2 includes a double-layer board. In some other embodiments, the first circuit board 2 includes a multi-layer board. The size and the structure of the first circuit board 2 is arranged and selected according to the requirements and is within the scope of the present disclosure.

As shown in FIGS. 4 to 6, FIGS. 4 to 6 show schematic views of the structure of the second embodiment of the present disclosure. The second embodiment is similar to the first embodiment but an input power terminal 12 is a European standard power input socket. The input power terminal 12 is electrically coupled to the second circuit board 3 via the first circuit board 2.

As shown in FIGS. 7 to 9, FIGS. 7 to 9 show schematic views of the structure of the third embodiment of the present disclosure. The third embodiment is similar to the first embodiment but an input power terminal 13 is an American standard power input socket. The input power terminal 13 is electrically coupled to the second circuit board 3 via the first circuit board 2.

Compared with the first embodiment, the second embodiment and the third embodiment, only the first circuit board 2 is required to be replaced according to the type of the input power terminal 13, without replacing the second circuit board 3, to increase generality of the power input assembly, when different types of the input power terminals are adopted.

Therefore, compared with the existing technology, the universal power input assembly disclosed by the present disclosure includes the first circuit board, coupled to the input power terminal, for achieving the connection of the input power and the motherboard. When different types of input power terminals are required to be installed, only the first circuit board is required to be replaced according to the type of the input power terminal, without replacing the second circuit board, to increase generality of the power input assembly, when different types of the input power terminals are adopted. The second circuit hoard is configured as a motherboard.

The input power terminal is soldered on the first circuit board for easy assembling. The pin of the assembled input power terminal is applied with less stress, higher fixing strength, higher safety and reliability.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A universal power input assembly, comprising: an input power terminal; a first circuit board; a second circuit board; a case for holding the first circuit board and the second circuit board; wherein the input power terminal is electrically coupled to the first circuit board, and the first circuit board includes a first connector and a second connector, wherein a first end of the first connector is electrically coupled to the first circuit board and a second end of the first connector is electrically coupled to the second circuit board; a first end of the second connector is electrically coupled to the first circuit board and a second end of the second connector is electrically coupled to the second circuit board; wherein the first circuit board is mounted on the case by a fastener and a ground terminal of the first circuit board is electrically coupled to the case by the fastener.

2. The universal power input assembly of claim 1, wherein the first connector is an L-shaped connector, and the L shape is formed by a first end of the L-shaped connector and a second end of the L-shaped connector.

3. The universal power input assembly of claim 1, wherein the first end of the first connector includes a first opening and the second end of the first connector includes a second opening, wherein the first end of the first connector is mounted on the first circuit board by a fastener passing through the first opening and the second end of the first connector is mounted on the second circuit board by a fastener passing through the second opening.

4. The universal power input assembly of claim 1, wherein a first end of the first connector is soldered on the first circuit board and a second end of the first connector is soldered on the second circuit board.

5. The universal power input assembly of claim 1, wherein the input power terminal is soldered on the first circuit board.

6. The universal power input assembly of claim 1, wherein the input power terminal is an Alternative Current (AC) power socket.

7. The universal power input assembly of claim 1, wherein the first circuit board is a double-layer printed circuit board.

8. The universal power input assembly of claim 1, wherein the first circuit board is a multi-layer printed circuit board.

9. The universal power input assembly of claim 1, wherein the first connector is a fastener, and the fastener has two ends respectively coupled to the first circuit board and the second circuit board.

10. The universal power input assembly of claim 9, wherein the first connector is a cylinder-shaped fastener, and the cylinder shape is formed by a bolt and a nut to receive the bolt.

* * * * *